US005579595A

United States Patent [19]

Dutton

[11] Patent Number: 5,579,595

[45] Date of Patent: Dec. 3, 1996

[54] STRETCHER BAR APPARATUS

[76] Inventor: Sydney R. Dutton, 428 N. Laurel Ave., Los Angeles, Calif. 90048

[21] Appl. No.: 558,020

[22] Filed: Nov. 13, 1995

Related U.S. Application Data

[63] Continuation-in-part of Ser. No. 286,511, Aug. 5, 1994, abandoned.

[51] Int. Cl.[6] ..... D06C 3/08; B44D 3/18

[52] U.S. Cl. ..... 38/102.1; 160/381

[58] Field of Search ..... 38/102, 102.1, 38/102.5, 102.91; 160/374.1, 378, 381; 101/127.1; 16/87 R, 87.2, 220; 52/222; 403/402, 403, 293, 295; 40/603

[56] References Cited

U.S. PATENT DOCUMENTS

| | | | |
|---|---|---|---|
| 953,758 | 4/1910 | Payntar | 160/381 |
| 1,018,099 | 2/1912 | Davis | 160/381 |
| 1,141,210 | 6/1915 | Pirson | 160/381 |
| 1,285,973 | 11/1918 | Fredman | 160/381 X |
| 1,344,093 | 6/1920 | Shogren | 160/381 |
| 3,211,089 | 10/1965 | Messerschmitt | 160/374.1 X |
| 4,301,853 | 11/1981 | Vidal | 38/102.5 X |

*Primary Examiner*—Ismael Izaguirre
*Attorney, Agent, or Firm*—Drucker & Sommers

[57] ABSTRACT

A stretcher bar frame for artists' backing material and kit to make same. Lengths of lumber rails of conveniently available standard sizes, such as 1"×3" and 2"×4", can be used with a plurality of molded corner bracket units, each having two channels sized to receive, and completely enclose the outer side walls of, the lumber rails. In a first embodiment, the corner brackets units have a bead region extending around their upper and outer perimeter. In other embodiments, separate bead members are provided, which can be cut to a desired length, for fixable attachment to the lumber rails to form a continuous bead region around the perimeter of the stretcher bar frame, such that when the backing material is stretched over the front of the stretcher bar, it rides on the outer perimeter bead, and not on the stretcher bar frame.

23 Claims, 4 Drawing Sheets

10

2
14
12

42
38
18
26a
26b
48
16a
30
54
14
38
16b
48
42
52
45
48
42
46

26
32
20
24
30
28
34
36
40
28
34
40
38
24
18
22
32
40
26

60
88
84
64
16a
68
94
76
76
68
16b
64a
80
78
66a
80
80
70a
76
62
72
70b
74
72
60
80
66b
74
78
68b
76
80
80
64b 78
64a
62
82

64b
78

STRETCHER BAR APPARATUS

CROSS REFERENCE TO RELATED APPLICATIONS

This is a continuation-in-part to U.S. Pat. application Ser. No. 08/286,511, filed Aug. 5, 1994, now abandoned.

BACKGROUND OF THE INVENTION

1. Field of the Invention

This invention relates to the field of stretcher bar frame members for artists' canvases, needlepoint backing material, and the like, and more particularly to a stretcher bar system and kit which comprises corner bracket units which matingly receive stretcher bar rail material, and which can be easily assembled by the artists to form stretcher bar frame members of any desired size.

2. Description of the Prior Art

There are countless professional and amateur painters in the U.S. and around the world. Painting with oil paints (and more recently with acrylic and alkaloid paints) on canvases stretched across wood frames dates back hundreds of years, and continues to be the painting surface of choice for many. The ability to build strong, yet economical frames, which frames allow the canvas to be tightly stretched and attached thereto remains a concern. Many artists purchase pre-assembled frames with the canvas already attached and stretched thereto. However, some artists desire frame sizes of different dimensions and/or prefer to prepare their own canvases.

The Applicant is aware of two relevant patents. U.S. Pat. No. 4,565,020 to Beatriz et al. discloses the use of right angle corner members into which ordinary lumber pieces for the frame can be engaged and slidably held in place by screws passing through slots formed in the right angle corner member. The frame members have exposed mitered corners which can be pushed outwardly by bolts inserted into threaded apertures or wedges inserted into compartments to further stretch the canvas. The Beatriz et al. patent also teaches that the right angle corner members will tilt the upper surface of the frame lumber such that the canvas rides on the outer edges of the frame lumber, and does not overlay the entire upper surface of the frame lumber. One problem with the Beatriz et al. device is that since the corners of the frame do not tightly hold the wood frame members together, and the tension of the canvas is required to prevent the wood frame members from moving relative to each other. Another problem is the requirement that the corners be carefully mitered.

U.S. Pat. No. 3,651,854 to Terna discloses a stretcher for canvas or other materials which is assembled from mitered cut profile strips which are assembled with angle irons into the frame. The outer perimeter of the strips are formed to have a raised perimeter edge, which lifts the stretched canvas, so that it does not contact with the entire upper surface of the strips. The Terna frame requires specialized profile strips, which would likely be costly. Moreover, the corners must be carefully mitered.

There accordingly remains a need for economical and sturdy frame members for artists canvases, which can be used by the artist to easily form strong frames, having perfect square corners, for artist canvases of any size and dimension, for needlepoint usage, and for other materials as well.

BRIEF SUMMARY OF THE INVENTION

The invention provides a stretcher bar apparatus for artists' canvases, and the like, utilizing rail sections having outer sides and upper sides, said apparatus comprising:

a plurality of corner brackets, each corner bracket having two channels formed therein, and sized to slideably receive rail sections, said channels being offset by a desired corner angle, each said channel having outer side wall sections, inner side wall sections, front wall sections, and rear wall sections, said outer wall sections having a bead region extending therefrom, along its outer perimeter, above the plane of the front wall sections; and a plurality of bead members for attachment to the rail sections to extend above the upper sides of the rail sections, said bead members of said corner brackets and said bead members, for attachment to said rail sections forming a contiguous raised perimeter bead.

The invention further provides a kit for making stretcher bar frames for artists' backing material, said kit being for use with lumber cut to desired lengths as rail sections, said kit comprising:

a plurality of corner bracket portions, each having two channels sized to fixably receive said rail sections, said corner brackets having outer side wall sections, inner side wall sections, front wall sections and rear wall sections, said outer wall sections having a bead region extending therefrom and above the plane of the front wall sections; and a plurality of bead members for attachment to the rail sections fit into the channels of the corner brackets, said bead members having a bead which extends above the upper face of the rail sections, said bead of the bead member and bead region of the corner brackets forming a contiguous raised perimeter bead, such that when the backing material is stretched over the front of the stretcher bar, it rides on the perimeter bead wall.

The invention yet further provides a stretcher bar apparatus for canvases, utilizing rail sections having outer sides and upper sides, said apparatus comprising:

a plurality of corner brackets, each corner bracket having two channels formed therein and sized to receive rail sections, said channels being displaced at a predetermined corner angle, each said channel being defined by outer side wall sections, inner side wall sections, front wall sections, and rear wall sections; and a plurality of bead members for attachment to the rail sections to extend above the upper sides of the rail sections to form a contiguous raised perimeter bead around the assembled stretcher bar apparatus.

The invention finally provides a kit for making stretcher bar frames for artists' backing material, said kit being for use with lumber cut to desired lengths as rail sections, said kit comprising:

a plurality of corner bracket portions, each having two channels sized to fixably receive said rail sections, said corner brackets having outer side wall sections, inner side wall sections, front wall sections and rear wall sections, said outer wall sections having a bead region with a bead extending therefrom and above the plane of the front wall sections; and a plurality of bead members for attachment to the rail sections fit into the channels of the corner brackets, said bead members having a bead region, which bead member when attached to the rail sections will form a contiguous raised perimeter bead which will extend above the upper face of the rail sections, such that when the backing material is applied to the stretcher bar frame, the backing material contacts the perimeter bead and is displaced above the front wall sections of the bracket portion and above the upper face of the rail sections.

DETAILED DESCRIPTION OF THE INVENTION

Figures 1, 2, 3, 4:
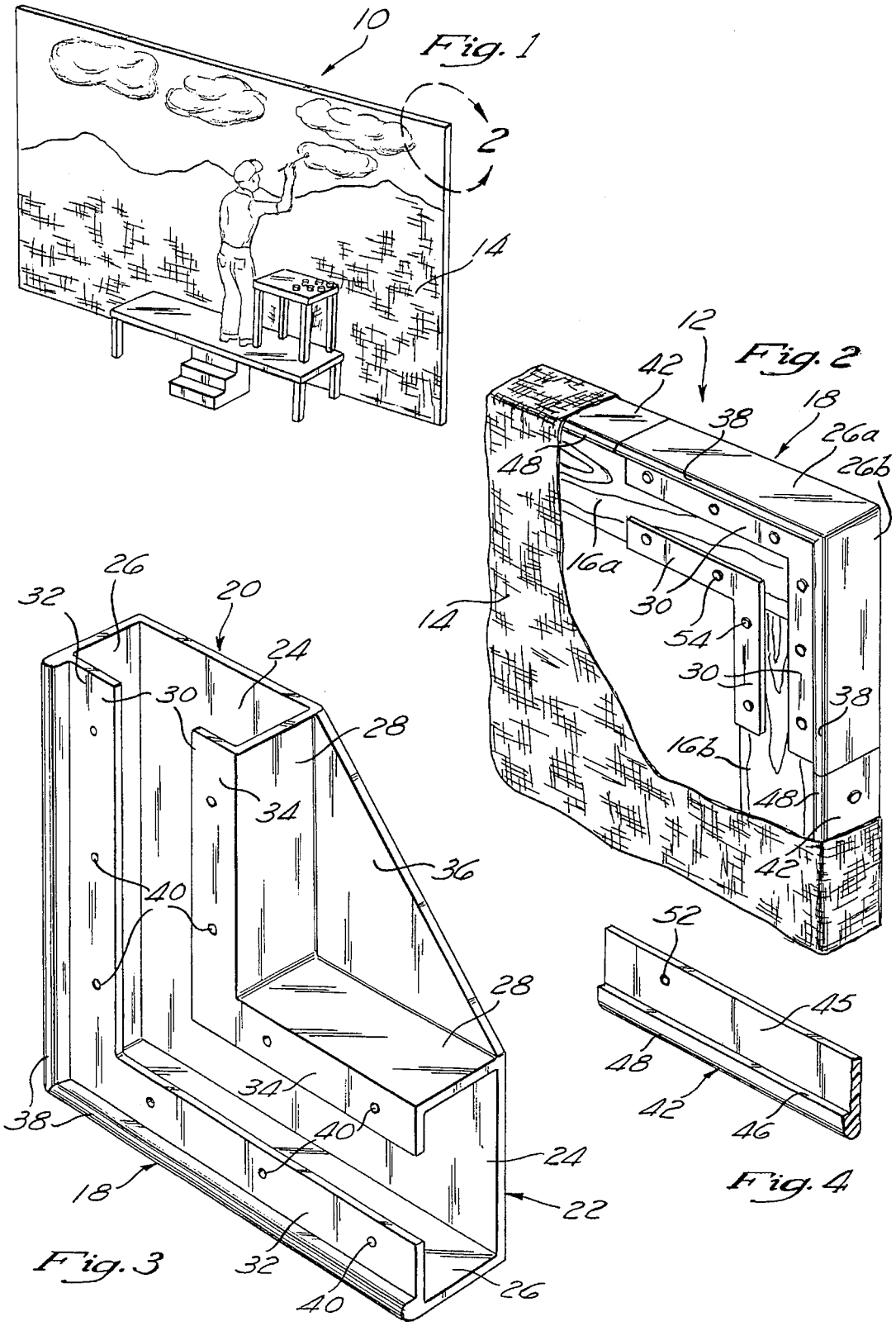
FIG. 1 is a perspective view of an artist painting a canvas stretched over a large stretcher bar frame of the invention.
FIG. 2 is a partially exposed perspective detail of the dashed circle 2 of FIG. 1, showing the joining of the rail sections, a first embodiment of the corner bracket, and bead members.
FIG. 3 is a perspective view of the corner bracket of the invention of FIG. 1.
FIG. 4 is a perspective view of a length of the bead member.

Referring to FIG. 1, a large artist's canvas 10 is shown, utilizing the stretcher bar system of the invention. Turning to FIG. 2, a detail of the corner portion of the artists canvas in the dashed circle 2 of FIG. 1 is shown. A portion of the assembled stretcher bar system 12 is shown, with the canvas or other covering material 14 cut away. The stretcher bar system 12 utilizes rail sections 16*a* and 16*b*, engaged with corner brackets units 18 and bead members 42.

Referring to FIG. 3, a corner bracket unit 18 of the invention is shown. The corner bracket unit 18 has two channels 20 and 22, offset from each other by a desired corner angle. For typical rectangular canvases, the channels 20 and 22 will be offset by 90 degrees. Other degree of offset, i.e. 60 degrees for a triangle, or 120 degrees for a hexagonal shape can also be provided. The channels 20 and 22 each have rear wall 24, outer side walls 26*a*, 26*b* inner side walls 28 and upper walls 30. For ease of manufacturing and greater adjustability with slightly off size lumber rails 16, the upper walls 30 can be divided into outside upper portions 32, extending from the outer side walls 26, and inside upper portions 34, extending from the inner side walls 28. To give the corner bracket unit 18 greater rigidity, a corner plate section 36 is optionally provided to extend between the inner side walls 28 of the two channels 20 and 22. A bead region 38 extends from the outer side walls 26, rising above the outside and inside upper walls 32 and 34, and preferably has a rounded profile. The channels 20 and 22 are ideally sized to receive standard size lumber, such as 1"×2", 1"×3", and 2"×4" lumber, cut to the desired rail lengths 16, such that the cost of the unit can be kept low.

The corner bracket units 18 comprise, ideally, molded plastic or composite materials, although they can also be made of metal. A plurality of apertures 40 are provided in the outside and inside upper walls 32 and 34, and apertures can also be formed in other walls 26, 27 and/or 28 of the corner bracket unit 18, if desired. It is through these apertures 40 that the lumber rails 16*a* and 16*b* will be nailed or screwed together with the corner brackets 18. For plastic material, the apertures 40 might be dispensed with where the nails, brads or staples can puncture the plastic material.

Figure 5:
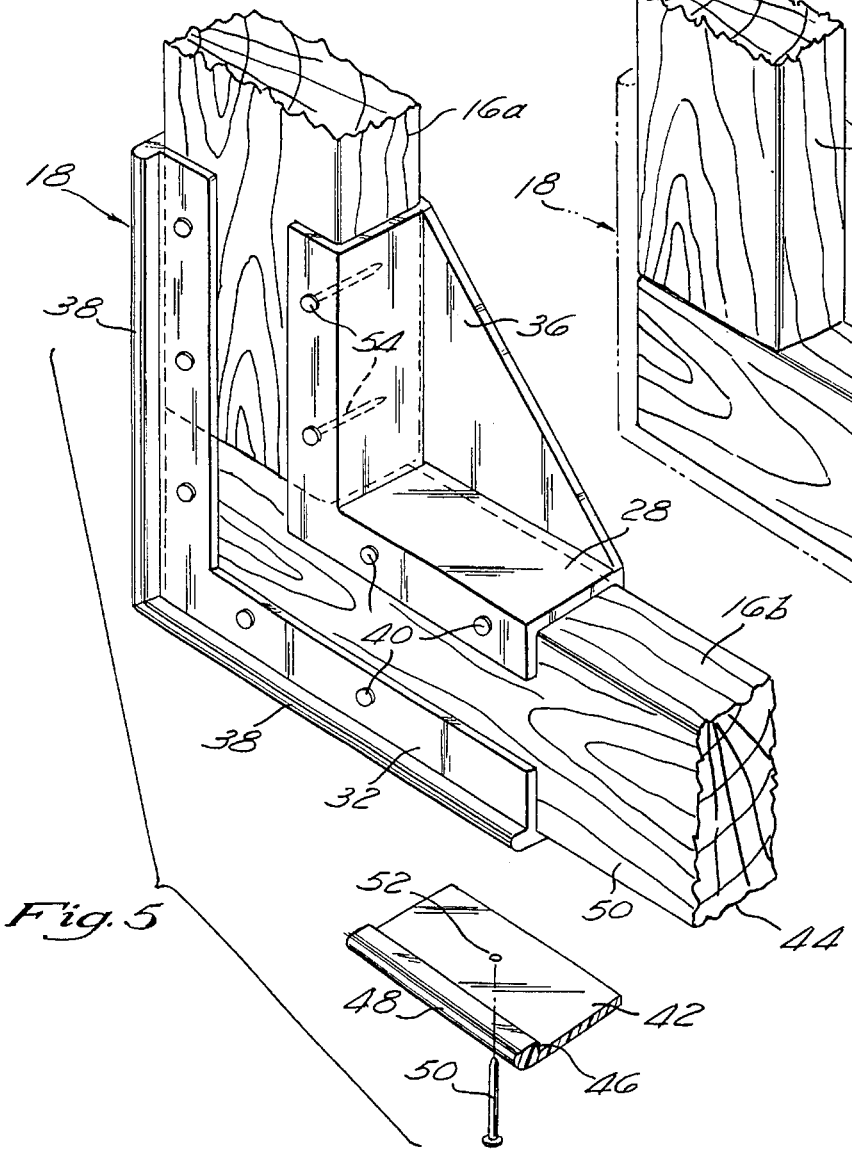
FIG. 5 is a perspective view showing the assembled lumber rails, corner bracket of FIG. 1 and bead members.

FIG. 4 is a perspective view of a length of bead member 42, which is attached to the outer sides 44 of the lumber rails 16, as is best shown in FIGS. 2 and 5. The bead member 42 has a side wall extension or nailing member 45 terminating at one end in a lip 46 and a rounded bead 48. The lip 46 will seat on the outer edge 50 of the lumber rails 16. The nailing member 45 abuts, and is nailed to the outer sides 44 of the lumber rails 16, with the lip 46 extending beyond sides 44 of the lumber rails 16 to create an uniform bead line with the bead line of the corner bracket units 18.

Nailing holes 52 are provided in the bead member 42, through which nails (or brads or staples) 54 can be driven into the outer sides 44 of the lumber 16. Optionally, the nails, bead or staples might be driven directly through the material where the materials is plastic or thin metal. The end user can conveniently cut the material himself or herself to the correct length to fit on the lumber rails 16 between the corner bracket units 18.

Figure 6:
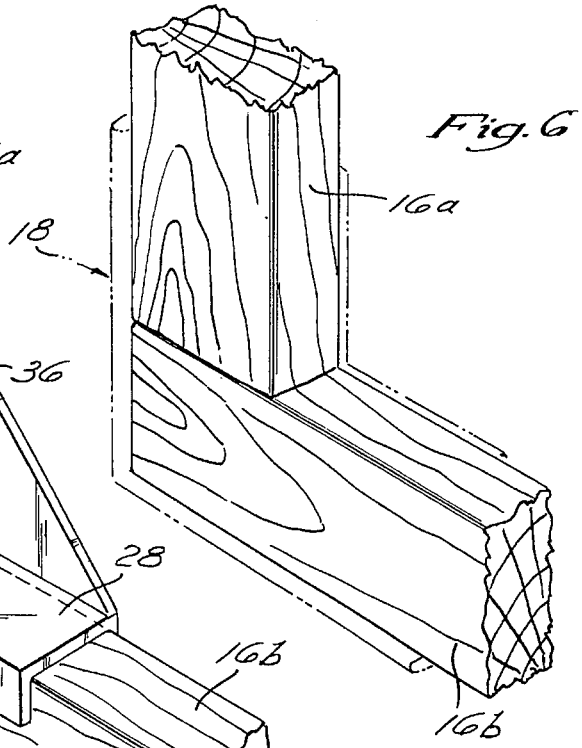
FIG. 6 is a partially exposed view of the lumber rail members in a corner bracket of FIG. 1.
Figure 7:
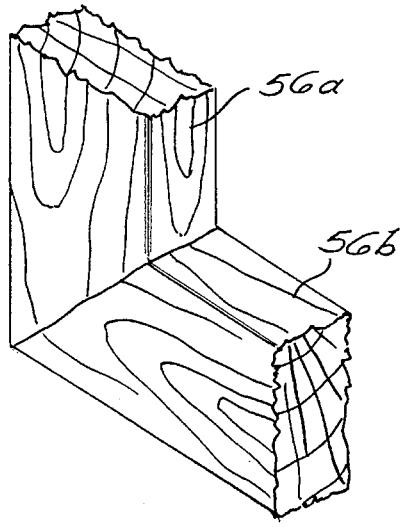
FIG. 7 is a perspective view of miter cut lumber rail members.

Referring to FIG. 5, a corner of the completed stretcher frame member 18 without canvas covering is shown. The lumber rails 16 are inserted into the channels 20 and 22 of the corner bracket unit 18, and nailed, screwed, or stapled through the aperture 40. FIGS. 2 and 5 depict nailing. The lumber rails 16*a* and 16*b* are butted against each other in corner bracket unit 18. FIG. 6 is a partially exposed view showing the square cut lumber rails 16*a* and 16*b* butting against each other. FIG. 7 depicts miter cut lumber rails 56*a* and 56*b* abutting each other. The butt joints or miter joints of the rails 16 need not be precisely cut since the joints are hidden by the corner bracket members, and the canvas itself.

The outer side walls 26, 26*b* completely enclose the outer corner of the corner bracket unit, so that precise abutment of the rail members within the corner bracket units is unnecessary.

Turning again to FIG. 1, the assembled stretcher bar system 12 thus forms a raised bead perimeter comprising the bead regions 38 of the corner bracket units 18 and the beads 48 of the bead member 42. When canvas 14, or other sheet material is stretched over the thusly formed stretcher bar system 12, the canvas 14 will ride on the bead perimeter 38 and 48, and not contact with the front face of the lumber rails 16*a* and 16*b*. In this way, the artist may paint or work the material (i.e. in the case of needlepoint), right out to the outer edges without encountering the underlying stretcher bar unit 18. The canvas 14 or other flexible material will be wrapped around and attached, i.e. by staples, to the rear of the rail section 16 (not shown). The canvas material may be further stretched, by wetting the attached canvas and letting it dry.

A second embodiment of the invention is shown in FIGS. 8–11. In the second embodiment, the corner bracket 60 has a backing plate 62 with outer side wall extensions 64*a* and 64*b*. These outer side wall extensions 64*a* and 64*b* help retain edge regions of the rail sections 16*a* and 16*b* retained therein, but do not have outer perimeter front wall sections or the integral corner bead portion as with the first embodiment. Inner side walls 66*a* and 66*b* extend from the backing plate 62, and have front wall portions 68*a* and 68*b* which extend in the direction of the outer side wall extensions 64*a* and 64*b*. Where rectangular cross-sectioned rail sections 16*a* and 16*b* are used, the front wall portions 68*a* and 68*b* will be generally parallel to the backing plate 62. For ease of manufacturing the corner brackets 60, the inner side wall 66*a* and 66*b* and its carried front wall portion 68*a* and 68*b* can be part of a generally "Z" shaped material, with a backing plate attachment foot 70*a* and 70*b*, which foot 70*a* and 70*b* is attached, for example, with spot welds 72 or screws, rivets, adhesives, or other means to the backing plate 62. Partial notch-outs 74 are formed on portions of the side wall extension 64 and on the backing plate 62. U-shaped clips 76 are provided which fit in the notch-outs 74. In each bracket 60, two rail section receiving channels 78 are thus formed.

Figures 8, 9, 12:
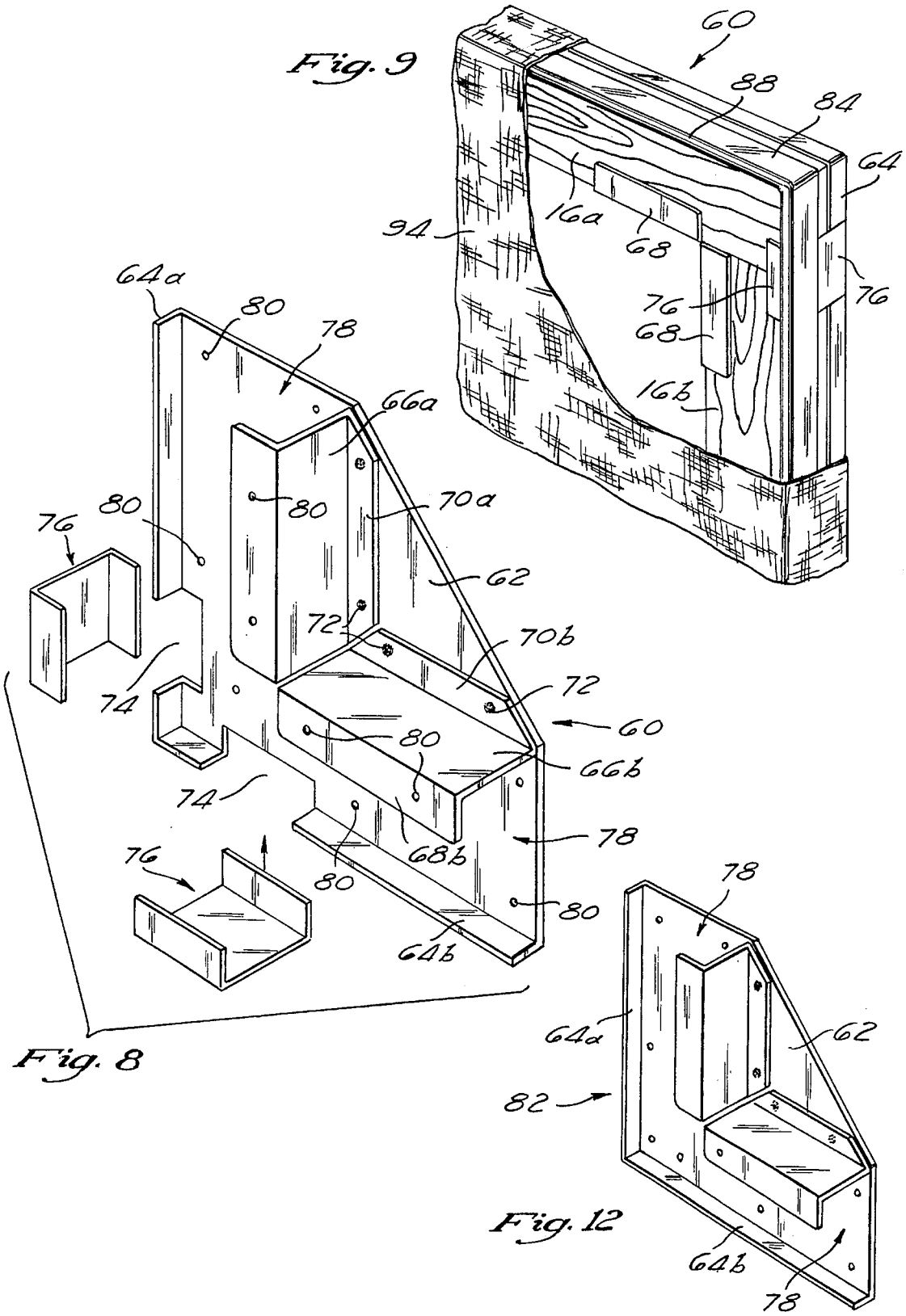
FIG. 8 is a perspective view of the second embodiment of a corner bracket of the invention, with rail retention clips.
FIG. 9 is a partially exposed perspective detail of the dashed circle 2 of FIG. 1, showing the joining of the rail sections, a second embodiment of the corner bracket, and bead members.
FIG. 12 is a perspective view of a third embodiment of the corner bracket, for use without rail retention clips.
Figure 10:
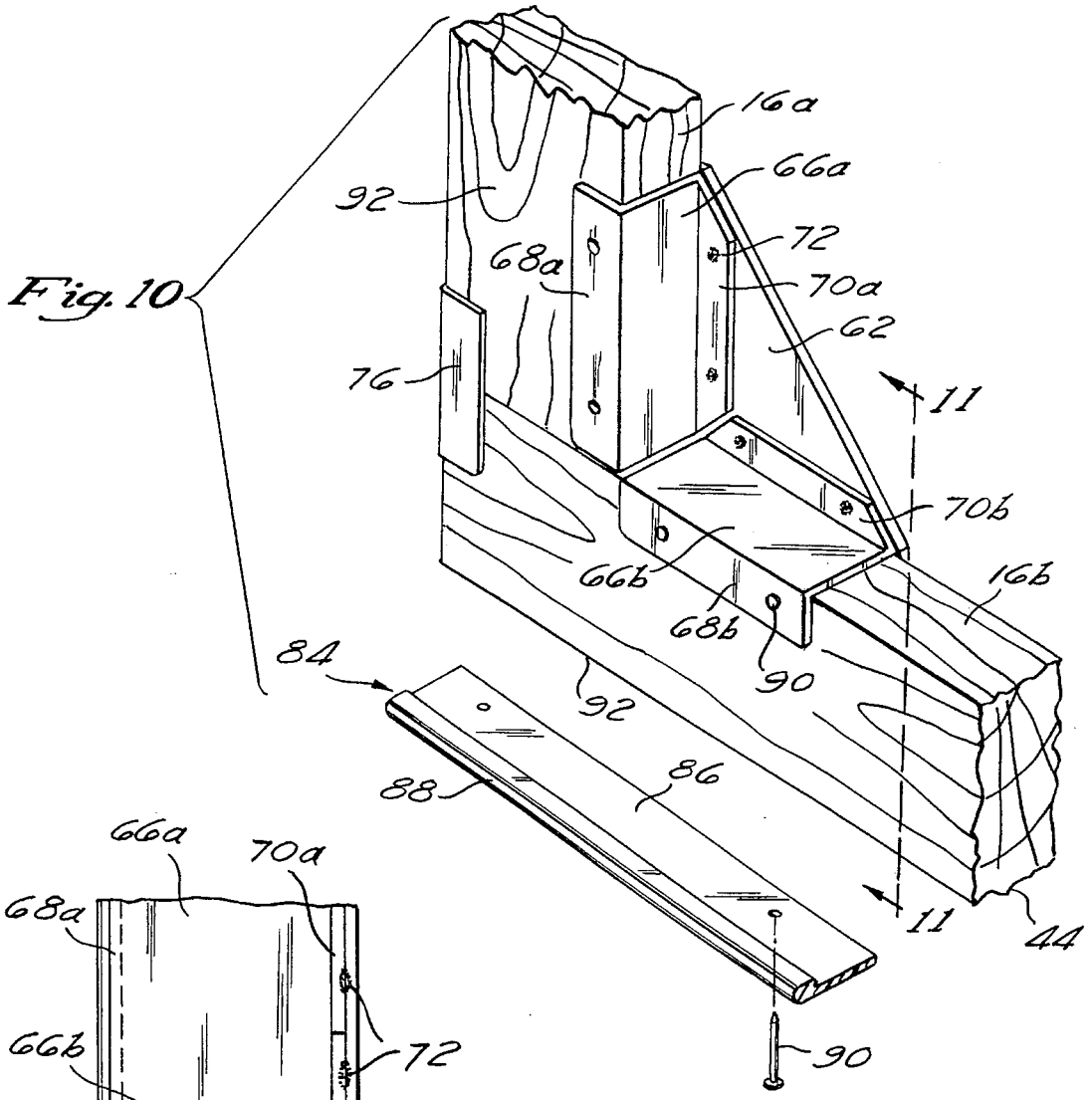
FIG. 10 is a perspective view showing the assembled lumber rails, corner bracket and clips of FIG. 8 and bead members.
Figure 11:
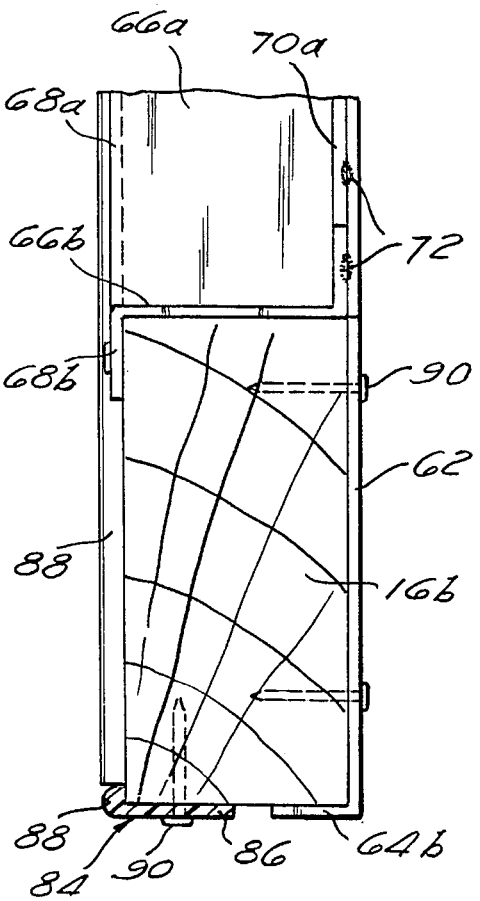
FIG. 11 is a cross-sectional through view lines 11—11 of FIG. 10.

Referring to FIGS. 9 and 10, the clips 76 are used to help retain and secure the rail sections 16*a* or 16*b* together in the corner brackets 60 by clamping the two rail sections 16*a* and 16*b* together to prevent them from twisting apart. The rails 16*a* and 16*b* can be nailed or screwed to the corner bracket 60 through holes 80 in the backing plate 62 and/or in the front wall portions 68*a* and 68*b*.

Referring to FIG. 12, a third embodiment of a corner bracket 82 is shown. It does not have notch-outs or clips. Otherwise, it is identical to the second embodiment of FIGS. 8–11.

In the embodiments of FIGS. 8–12, a separate corner bead member 84 having an attachment wall 86 and bead portion 88 is attached to the rails sections 16*a* and 16*b*, either by nails 90, staples, adhesives or other means such that its bead portion 88 extends above the plane of the front wall portion 68 and lies around a frontmost, outer perimeter 92. The canvas 94 or other material will thus ride on the bead portion 90. This corner bead member 84 can be provided in roll or strips and comprise plastic or other material which can be cut to size to fit any size of canvas an artist desires to assemble. In lieu of the corner bead member 84, separate sections of molding can be attached to the rail sections 16*a* and 16*b*, or even cord, doweling, or other material can be glued to the front face of the rails sections at or near its frontmost perimeter 92 (not shown.) However, the preferred embodiment is the corner bead member 84.

The corner bracket units 18, 60 and 82 and bead members 42 and 84 can be sold in a kit form, with the artist or hobbyist providing the lumber rails, so that any desired size stretcher frame can be made by the artist.

The drawings and the foregoing description are not intended to represent the only form of the invention in regard to the details of its construction and manner of operation. In fact, it will be evident to one skilled in the art that modifications and variations may be made without departing from the spirit and scope of the invention. Changes in form and in the proportion of parts, as well as the substitution of equivalents, are contemplated as circumstances may suggest or render expedient. Although specific terms have been employed, they are intended in a generic and descriptive sense only and not for the purpose of limitation, the scope of the invention being delineated in the following claims:

I claim:

1. A stretcher bar apparatus for canvases, utilizing rail sections having outer sides and upper sides, said apparatus comprising:

a plurality of corner brackets, each corner bracket having two channels formed therein, and sized to slideably receive rail sections, said channels being displaced at a predetermined corner angle, each said channel having outer side wall sections, inner side wall sections, front wall sections, and rear wall sections, said outer wall sections having a bead region extending therefrom, along an outer perimeter, above the plane of the front wall sections; and a plurality of bead members for attachment to the rail sections to extend above the upper sides of the rail sections, said bead member having a bead surface along one edge, said bead region of said corner brackets and said attached bead members forming a contiguous raised perimeter bead around the assembled stretcher bar apparatus.

2. The stretcher bar apparatus of claim 1, further comprising fixation means to fixably retain the corner brackets and the rail sections together, said fixation means comprising one of nails, brads, screws and staples which pass through the corner brackets and into the rail sections.

3. The stretcher bar apparatus of claim 1, wherein the corner brackets are made of pre-formed plastic material.

4. The stretcher bar apparatus of claim 1, wherein the two channels of the corner brackets are offset at right angles.

5. The stretcher bar apparatus of claim 1, wherein the corner brackets further comprise a reinforcing corner plate at least partially bridging the inner side walls of the two channels.

6. The stretcher bar apparatus of claim 1, wherein each of said bead members include an extension member, for nailing to each of said rail sections.

7. The stretcher bar apparatus of claim 1, wherein the channels of the corner brackets are sized to receive standard sized lumber as the rail sections.

8. The stretcher bar apparatus of claim 1, wherein the outer side walls of the corner brackets together with the said canvas, when stretched completely enclose said rail members.

9. A kit for making stretcher bar frames for artists' backing material, said kit being for use with lumber cut to desired lengths as rail sections, said kit comprising:

a plurality of corner bracket portions, each having two channels sized to fixably receive said rail sections, said corner brackets having outer side wall sections, inner side wall sections, front wall sections and rear wall sections, said outer wall sections having a bead region with a bead extending therefrom and above the plane of the front wall sections; and a plurality of bead members for attachment to the rail sections fit into the channels of the corner brackets, said bead members having a bead, which bead member when attached to the rail sections has its bead extending above the upper face of the rail sections, said bead of the bead member and said bead of said bead region of the corner brackets forming a contiguous raised perimeter bead, such that when the backing material is applied to the stretcher bar frame, the backing material contacts the perimeter bead and is displaced above the front wall sections of the bracket portion and above the upper face of the rail sections.

10. A kit for making stretcher bar frames for artists' backing material of claim 9, wherein the corner brackets are capable of receiving square cut or mitered cut rail sections with imprecisely cut ends, without affecting the integrity of the assembled stretcher bar frames.

11. The kit for making stretcher bar frames for artists' backing material of claim 9, wherein each corner bracket further comprises a reinforcing corner plate at least partially bridging the two channels, to thereby strengthen the corner bracket.

12. The kit for making stretcher bar frames for artists' backing material of claim 9, wherein the two channels are offset at about right angles, and communicate with each other to permit the rail sections to be inserted therein and abut each other if desired.

13. A stretcher bar apparatus for canvases, utilizing rail sections having outer sides and upper sides, said apparatus comprising:

a plurality of corner brackets, each corner bracket having two channels formed therein and sized to receive rail sections, said channels being displaced at a predetermined corner angle, each said channel being defined by outer side wall sections, inner side wall sections, front wall sections, and rear wall sections; and a plurality of bead members for attachment to the rail sections to extend above said front wall sections of said corner brackets and the upper sides of the rail sections to form a contiguous raised perimeter bead around the assembled stretcher bar apparatus.

14. The stretcher bar apparatus of claim 13, further comprising fixation means to fixably retain the corner brackets and the rail sections together, said fixation means comprising one of nails, brads, screws and staples which pass through the corner brackets and into the rail sections.

15. The stretcher bar apparatus of claim 13, wherein the corner brackets are made of pre-formed plastic material.

16. The stretcher bar apparatus of claim 13, wherein the corner brackets are made of metal.

17. The stretcher bar apparatus of claim 13, wherein the two channels of the corner brackets are offset at right angles.

18. The stretcher bar apparatus of claim 13, further comprising clips which fit into notches formed in parts of the outer wall sections and rear wall sections, said clips acting to clamp together adjacent ends of the rail sections.

19. The stretcher bar apparatus of claim 13, wherein each of said bead members include an attachment wall section for fixation to said rail sections.

20. The stretcher bar apparatus of claim 13, wherein the channels of the corner brackets are sized to receive standard sized lumber as the rail sections.

21. A kit for making stretcher bar frames for artists' backing material, said kit being for use with lumber cut to desired lengths as rail sections, said kit comprising:

a plurality of corner bracket portions, each having two channels sized to fixably receive said rail sections, said corner brackets having outer side wall sections, inner side wall sections, front wall sections and rear wall sections, said outer wall sections having a bead region with a bead extending therefrom and above the plane of the front wall sections; and a plurality of bead members for attachment to the rail sections fit into the channels of the corner brackets, said bead members having a bead region, which bead member when attached to the rail sections will form a contiguous raised perimeter bead which will extend above the upper face of the rail sections, such that when the backing material is applied to the stretcher bar frame, the backing material contacts the perimeter bead and is displaced above the front wall sections of the bracket portion and above the upper face of the rail sections.

22. A kit for making stretcher bar frames for artists' backing material of claim 21, wherein the corner brackets are capable of receiving square cut or mitered cut rail sections with imprecisely cut ends, without affecting the integrity of the assembled stretcher bar frames.

23. The kit for making stretcher bar frames for artists' backing material of claim 21, wherein the two channels are offset at about right angles, and communicate with each other to permit the rail sections to be inserted therein and abut each other if desired.

* * * * *